US005140777A

United States Patent [19]

Ushiyama et al.

[11] Patent Number: 5,140,777

[45] Date of Patent: Aug. 25, 1992

[54] METHOD AND APPARATUS FOR POLISHING OPTICAL ELEMENTS

[75] Inventors: Kazuo Ushiyama, Akishima; Masaki Watanabe, Hachiooji; Mitsuaki Takahashi, Hachiooji; Takayuki Kishida, Hachiooji, all of Japan

[73] Assignee: Olympus Optical Company Limited, Japan

[21] Appl. No.: 591,132

[22] Filed: Oct. 1, 1990

[30] Foreign Application Priority Data

Sep. 29, 1989 [JP] Japan ..... 1-254724

[51] Int. Cl.[5] ..... B24B 49/00

[52] U.S. Cl. ..... 51/165.71; 51/165.74; 51/165.76; 51/284 R; 51/124 L

[58] Field of Search ..... 51/165.71, 165.74, 165.76, 51/284 R, 124 L, 129, 131.5

[56] References Cited

U.S. PATENT DOCUMENTS 4,216,626 8/1980 Starp ..... 51/124 L
4,524,419 6/1985 Headlund et al. ..... 51/124 L
4,768,308 9/1988 Atkinson, III et al. ..... 51/165.71
4,850,152 7/1989 Heynacher et al. ..... 51/165.71
4,908,997 3/1990 Field et al. ..... 51/165.71
4,956,944 9/1990 Ando et al. ..... 51/124 L

*Primary Examiner*—M. Rachuba
*Attorney, Agent, or Firm*—Bruce L. Adams; Van C. Wilks

[57] ABSTRACT

An apparatus for controlling the machining of optical elements is disclosed. The apparatus comprises the thus measured value of radius curvature with the measured value of radius curvature of previously polished lens, means for determining curvature correcting value by comparing the thus obtained curvature variation value with a previously set allowed value of radius curvature, means for determining correcting value of machining conditions during the swinging motion based on the thus determined curvature correcting value, and means for adjusting the machining conditions in accordance with the correcting value of machining conditions.

15 Claims, 7 Drawing Sheets

METHOD AND APPARATUS FOR POLISHING OPTICAL ELEMENTS

BACKGROUND OF THE INVENTION

The present invention relates to a method of and an apparatus for polishing optical elements. In particular, the present invention relates to a machining condition controlling method and apparatus for controlling a machining conditions of swinging motion in a lens polishing apparatus.

Such an apparatus is used for polishing optical elements. A conventional, polishing apparatus for use in a lens polishing machine is shown in FIG. 10. The apparatus comprises a polishing jig 1 for machining a lens 2 and capable of being rotated at a fixed position by a motor (not shown) or the like. A tip portion of a tommy bar 3 is pivotably engaged with a jig 4 for holding the lens 2 so as to depress the lens 2 against the polishing jig 1. The other end of the bar 3 is held movably up and down in a housing 7 which is secured to a tip portion of an arm 7 attached to an end of a connection shaft or rod 5 movably by a screw 6 or the like. The connection rod 5 is held slidably at its center portion by a carrying shaft 8 for performing a swinging motion. The other end of the rod 5 is rotatably engaged to an eccentric pin 9' provided in an eccentric plate 9 with a motor 10.

In such a lens polishing machine with the above construction, when the lens 2 is machined or polished, at first the lens 2 held by the fitting jig 4 is placed on the polishing jig 1, and then the fitting jig 4 is carried on the tommy bar 3. Under these conditions, when the shaft of the polishing jig 1 and the eccentric plate driving motor 10 are rotated, the connection rod 5 is moved right and left while swinging so that the tip portion of the connection rod is subjected to a quasi-circular motion, and thus the lens 2 is slid on the surface of the rotating polishing jig, while effecting the swinging motion, thereby being polished.

In this way, when a number of lenses are successively machined, the worker measures the radius curvature of respective polished lenses, while viewing its radius curvature the attached position to the connection shaft 5 of the arm 7 which carries the tommy bar 3, is changed and the effective length l of the arm 7 is also to thereby obtain the lens 2 having a desired radius curvature.

This operation requires technical skills, so that the operation must be performed by the experts, and thus becomes ineffective.

SUMMARY OF THE INVENTION

It is an object of the present invention to overcome the above described disadvantages of the conventional method of polishing optical elements.

It is another object of the present invention to provide a method of and apparatus for polishing optical elements capable of controlling the machining conditions in a lens polishing apparatus so as to stably machine a lens having precise radius curvature with a simple operation and without the need of technical skills.

According to the present invention, there is provided a method of polishing optical elements in which a surface of a lens to be machined, or a rotating polishing jig, is depressed onto a depressing and holding member, while swinging and sliding them, thereby polishing the lens. The method includes the steps of measuring a radius curvature of the polished lens, obtaining a curvature variation value by comparing the thus measured value of the radius curvature with the measured value of the radius curvature of previously polished lens. A curvature correcting value is determined by comparing the thus obtained curvature variation value with a previously set allowed value of radius curvature. A correcting value of machining conditions is determined during the swinging motion based on the thus determined curvature correcting value, and the machining conditions are adjusted in accordance with the correcting value of the machining conditions.

The correcting work condition determining step, the previous machining conditions and the measured value of the radius curvature variation ratio are statistically processed and correlated, thereby determining the condition. The machining condition is determined by the relative position of the lens to be machined and the polishing jig. The machining condition is determined by a variation of the depressed force during the swinging motion. The machining condition is determined by a variation of residence time during the swinging motion.

According to the present invention, a lens polishing apparatus is also provided in which a depressing and holding member is depressed onto a surface of a lens to be machined or a rotating polishing jig. The apparatus swings and slides them, thereby polishing the lens. The apparatus includes means for measuring radius curvature of the polished lens, means for obtaining curvature variation value by comparing the thus measured value of radius curvature with the measured value of radius curvature of previously polished lens. Means are provided for determining the curvature correcting value by comparing the thus obtained curvature variation value with a previously set allowed value of radius curvature. Means are provided for determining a correcting value of the machining conditions during the swinging motion based on the thus determined curvature correcting value, and means are provided for adjusting the machining conditions in accordance with the correcting value of machining conditions.

DETAILED EXPLANATION OF THE PREFERRED EMBODIMENT

Figure 2:
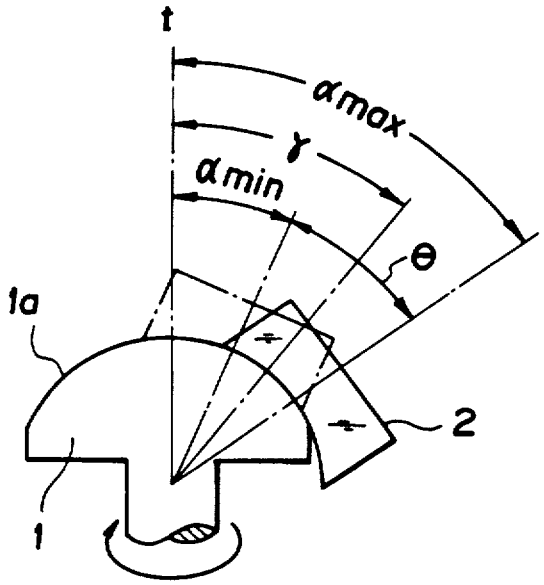
FIG. 2 is an explanatory view showing a fundamental principle of polishing a lens.

FIG. 2 shows a fundamental principle of lens polishing. A lens 2 is slid onto a spherical surface 1a of a working tool 1 which rotates about a shaft, while swinging, thereby performing the polishing. This swinging motion is moved within the, range of an angle of $\pm\theta/2$ by a circular motion, a quasi-circular motion, and a reciprocating motion, about a shaft in which the enter line of the lens 2 is tilted by an angle $\gamma$ from the shaft. The angle $\gamma$ is referred to as a relative angle and $\theta$ is referred to as a swinging angle. When the radius curvature of the lens 2 is large and substantially planes, and when the lens surface is a flat surface, it is suitable for the angle range of the swinging motion to designate an angle as a dimension, so that hereinafter, the relative angle is referred to as a relative position, and the swinging angle is referred to as a swinging width.

The present invention provides that the radius curvature of the polished lens is measured, the thus measured curvature value is compared with the measured curvature of the previously polished lens to obtain its variation value. The machining conditions, such as the relative position or the like, are automatically adjusted in accordance with the above curvature variation value, thereby stably machining or polishing the lens with precise radius curvature.

Figure 3:
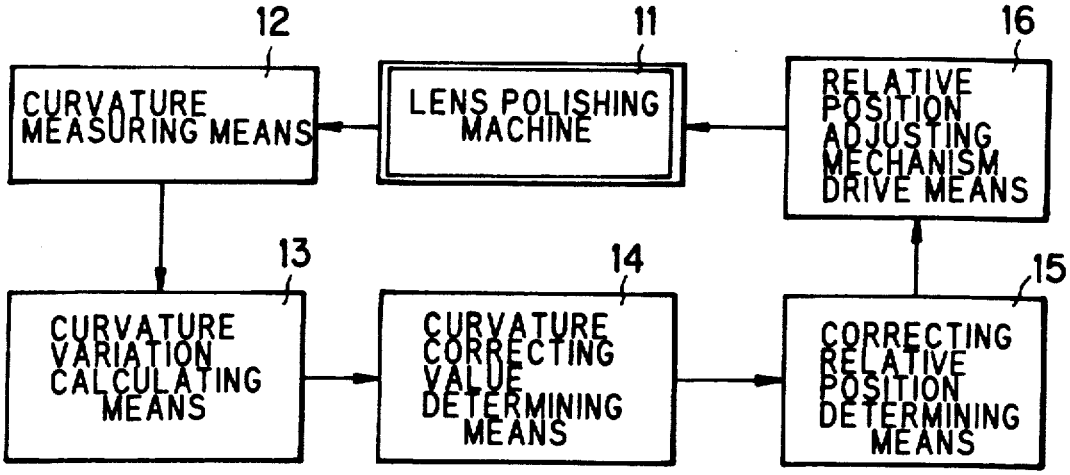
FIG. 3 is a block diagram showing a relative portion controlling device for a lens polishing machine according to the present invention.

FIG. 3 designates a block diagram showing a construction of a relative position controlling device of a lens polishing machine according to the present invention. Reference numeral 11 is a body of the lens polishing machine, numeral 12 is a curvature measuring means for measuring radius curvature of a lens which is polished by the lens polishing machine 11, and numeral 13 is a curvature variation calculating means for obtaining the curvature variation value by comparing the measured value due to the curvature measuring means 12 with the curvature measured value of previously polished lens. Reference numeral 14 is means for determining a curvature correcting value of a next polishing by comparing the curvature variation value obtained from the curvature variation calculating means 13 with an allowed value of previously set radius curvature, numeral 15 is means for determining a correcting relative position which corresponds with the curvature correcting value determined by the means 14, and numeral 16 is means for driving a relative position adjusting mechanism of the lens polishing machine 11 in accordance with the correcting relative position. These means 11 to 16 are arranged as shown in FIG. 3 to perform the control of the relative position.

Figure 4:
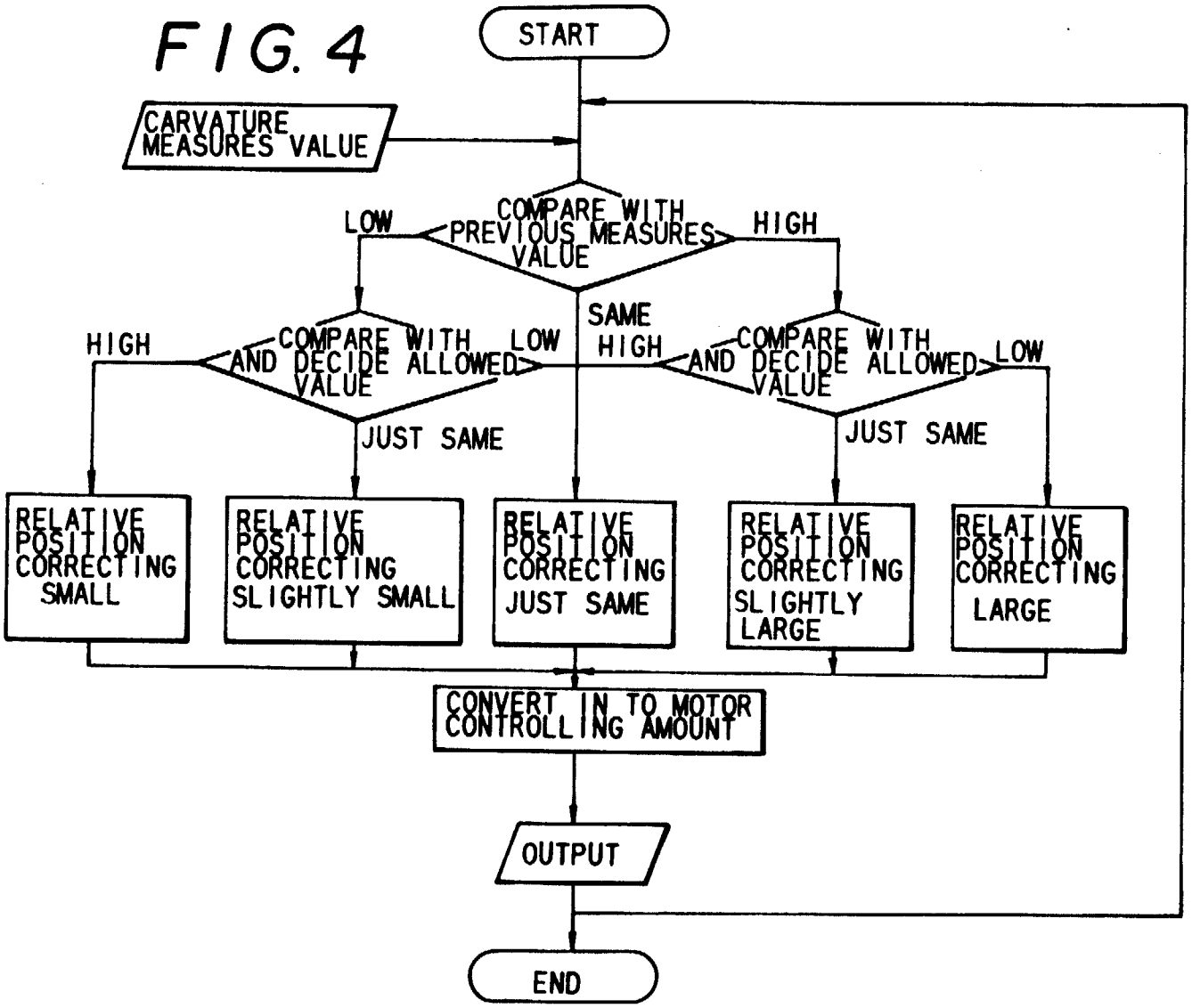
FIG. 4 is a flow chart showing respective constructional means of the relative position controlling device for use in the lens polishing machine.

FIG. 4 designates a flow chart showing the operation of respective means of the relative position controlling device of the lens polishing machine shown in FIG. 3 by the block diagram. At first, the relative position control device starts, a radius curvature of a lens which has been polished by the lens polishing machine 11 is measured by the curvature measuring means 12. The thus measured value of radius curvature is supplied to the curvature variation calculating means 13 in which it is compared with the previously measured curvature value to obtain a variation of the radius curvature. The previously measured curvature value as a comparative value may be set as the measured value of lens having been machined during the last polishing operation. The measured value of the lens having been machined at ten times before polishing may also be used as well as the measured value of a lens having been machined at any times before polishing when continuously polishing a number of lenses each with the same radius curvature.

Then, in the curvature correcting value determining means 14, the curvature variation value is compared with the allowed value of previously set radius curvature to determine a new correcting radius curvature for the next lens to be polished. In this case, when the curvature variation value is 0, a new lens polishing operation is performed while maintaining the relative angle as it is. Then, in the correcting relative position determining means 15, the correcting value of the relative position is determined according to the determined curvature correcting value. The correcting value of relative position may be set in accordance with the size of a lens or the like. When the correcting value of relative position is determined, the relative position adjusting mechanism drive means 16 is operated by taking the mechanism, size or the like of the lens polishing machine into consideration, and the relative position correcting amount is converted into a controlling amount of the control motor as an output. In this way, a given relative position is set by the operation of these means, thereby polishing and obtaining the lens having precise radius curvature.

First Embodiment

Figure 1:
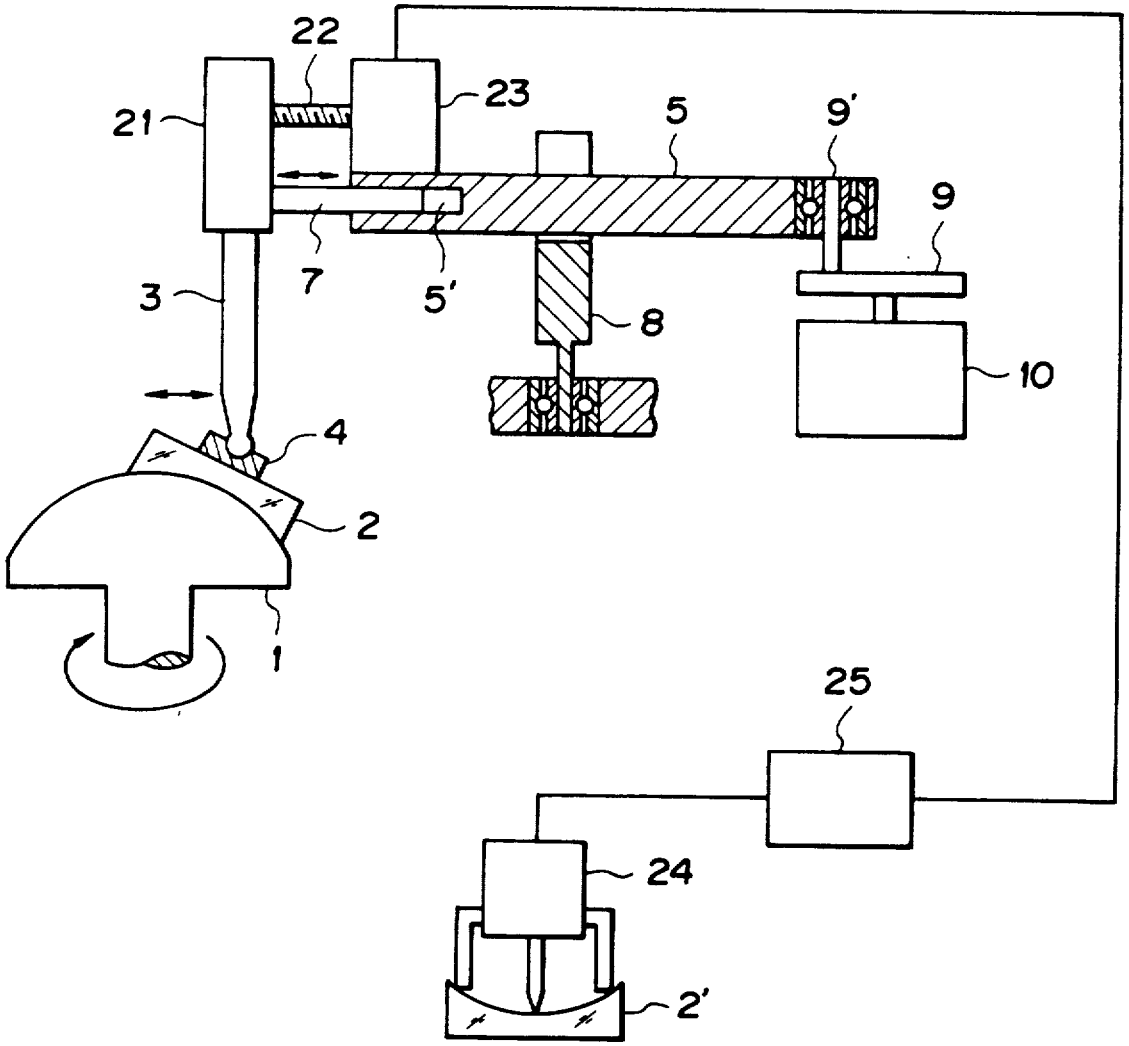
FIG. 1 is an explanatory view showing a first embodiment of an apparatus for polishing optical elements.
Figure 10:
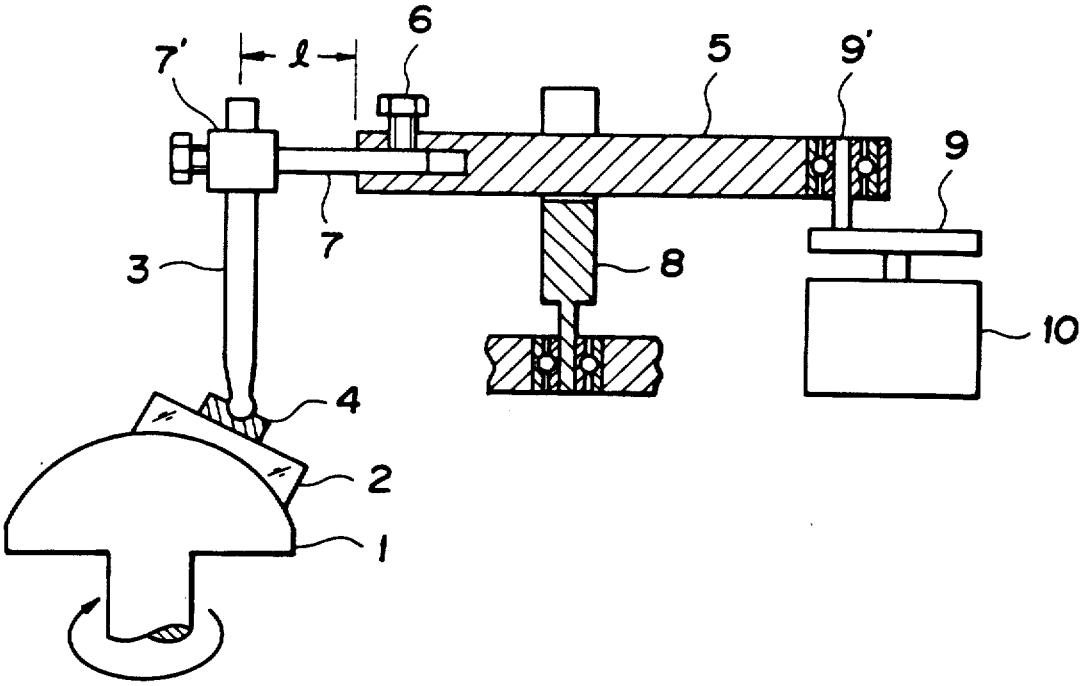
FIG. 10 is an explanatory view showing a construction of a conventional optical element polishing apparatus.

FIG. 1 shows a construction of first embodiment of an apparatus carrying out a method of polishing optical elements according to the present invention. In FIG. 1 parts similar to those previously described with reference to FIG. 10 are denoted by the same reference numerals. In this embodiment one end of a connection rod 5 is provided with a longitudinal fitting hole 5'. An arm 7 carrying a tommy bar 3 through a housing 21 is fitted in the hole 5' slidably in the direction of an arrow. The one end of the connection rod 5 is provided with a control motor 23 having a ball screw 22 which is screwed in a housing 21 carrying the tommy bar 3 therein. Reference numeral 24 is a measuring device for measuring radius curvature of the lens 2 that has been polished. The measured value of radius curvature from the measuring device 24 supplied to a control unit 25 consisting of the curvature variation calculating means 13, the curvature correcting value determining means 14 and the correcting relative position determining means 15. The output of the control unit 25 controls and drives the control motor 23.

When performing a lens polishing operation using the thus constructed relative position control device, at first the measuring device 24 measures the radius curvature of lens 2' which has already been polished. This measured value of radius curvature is supplied to the control unit 25, in which this measured curvature value is compared with the previously measured curvature value to calculate the variation value, this variation value is compared with the previously set allowed curvature value to determine the curvature correcting value. Next, the relative position correcting amount corresponding to the curvature correcting value is determined, thereby obtaining a control signal for driving the control motor in accordance with the relative position correcting amount. This control signal drives the control motor 23, so that the tommy bar 3 may be moved by an amount corresponding to the relative position correcting value, in the direction of the arrow, through the housing. When a polishing jig 1 having the lens 2 to be polished thereon and an eccentric plate 9 are rotated, the lens 2 is slid on the polishing jig 1, while a given controlled and set relative position and swinging are maintained, thereby performing the polishing. After having been polished, the same operation as that of a previous polishing operation is performed successively, thereby continuing to a next lens polishing operation.

Second Embodiment

Figure 5:
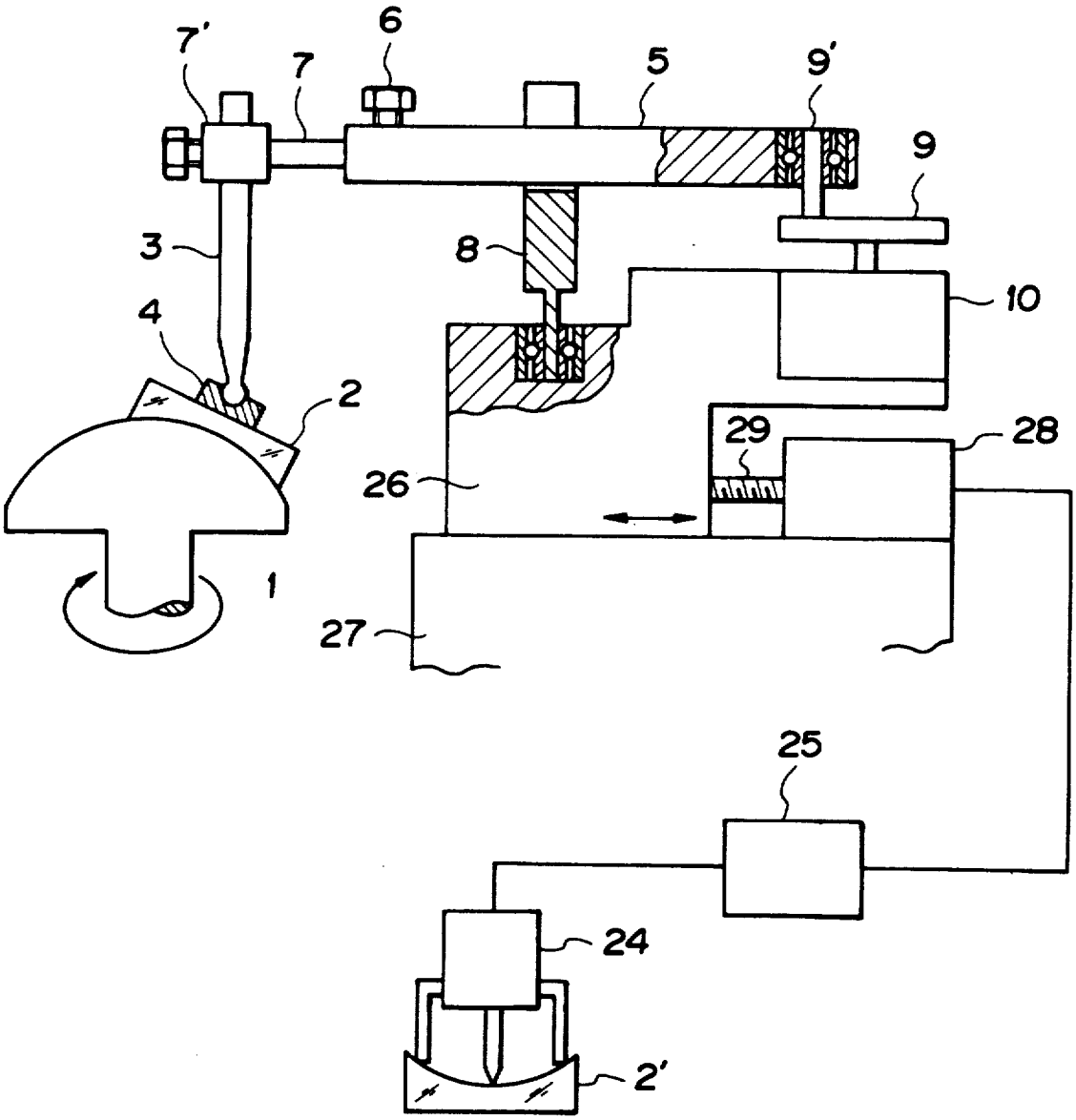
FIG. 5 is an explanatory view showing a second embodiment of an apparatus for polishing optical elements.

FIG. 5 shows the construction of second embodiment of an apparatus carrying out a method of polishing optical elements according to the present invention. In FIG. 5, parts similar to those previously described with reference to FIG. 10 are designated by the same reference numerals. In this embodiment, reference numeral 26 is a moving holder, or a carriage, on which a holding shaft 8 for swinging motion and a motor 10 for driving and rotating the eccentric plate 9 are provided. Reference numeral 27 is a holder having thereon a bed for carrying the carriage 26 movably in the direction of an arrow. A control motor 28 is placed on the holder 27 and is controlled and driven by the control motor 25. The control motor 28 is screwed to a housing (not shown) provided to the carriage 26 through a ball screw 29.

In the relative position control device thus constructed, the control motor 28 is driven by the control signal from the control unit 25, thereby moving the carriage 26 in the direction of an arrow through the ball screw 29 so that the position of the tommy bar is also moved against the polishing jig 1, and thus the relative position is corrected by an amount corresponding to the correcting value, thereby performing the polishing.

Third Embodiment

Figure 6:
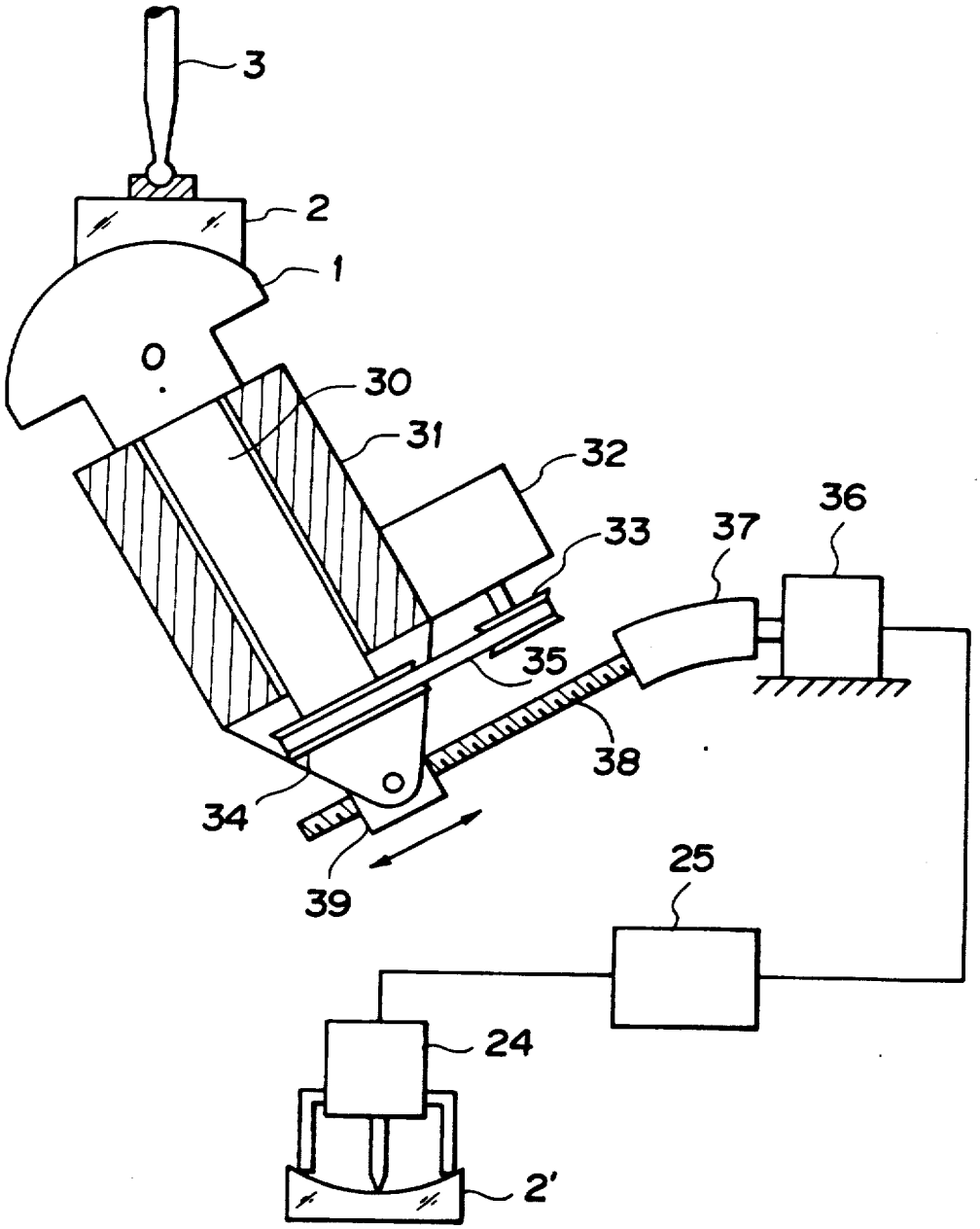
FIG. 6 is an explanatory view showing a third embodiment of an apparatus for polishing optical elements.

FIG. 6 shows a construction of a third embodiment of an apparatus carrying out a method of polishing optical elements according to the present invention. In FIG. 6, parts similar to those previously described with reference to FIG. 10 are denoted by the same reference numerals. In this embodiment, reference numeral 30 is a shaft to which a polishing jig 1 is secured. The shaft 30 is carried to a shaft holder 31 which is rotatable about point 0. Preferably, point 0 is a curvature center of the polishing jig 1. Reference numeral 32 is a motor secured to the shaft holder 31, numeral 33 is a pulley connected to the motor 32, numeral 34 is a pully connected to the jig shaft 30, and numeral 35 is a belt stretched on the pulleys. A relative position control motor 36 is provided on the lens polishing machine and is operated by the control signal from the control unit 25. The control motor 36 is connected through a universal joint 37 to a feed screw 38 which is screwed to a housing 39 rotatably secured to one end of the shaft holder 31.

In the relative position control device thus constructed, the relative position control motor 36 is driven by the control signal from the control unit 25, so that the control motor 36 rotates the shaft holder 31 about point 0 through the universal joint 37, the feed screw 38 and the housing 39. The rotation of the shaft holder 31 causes the polishing jig 1 to be rotated through the shaft 30, so that the relative position of the lens 2 is changed against the polishing jig 1, thereby adjusting the relative angle $\gamma$ in accordance with the correcting control amount from the control unit 25.

In the above respective embodiments, the polishing jig is rotated at a given position, and the lens to be machined is slid on the polishing jig while performing the swinging motion. The present invention is not limited to the above embodiments. For example, the relative arrangement between the lens and the polishing jig may be reversed, that is, the lens to be polished may be rotated and driven, and the polishing jig may be subjected to the swinging motion. An other depressing and holding member may be used instead of the tommy bar.

As the relative position adjusting mechanism, other mechanism may be used. For example, in FIG. 2 an angle $\alpha$ max of a combination of the relative angle $\gamma$ and an angle $\theta/2$ of the swinging motion $\theta$ is made fixed, and the swinging angle $\theta$ may be changed, resulting in a change of the relative angle $\gamma$.

Fourth Embodiment

Figure 7:
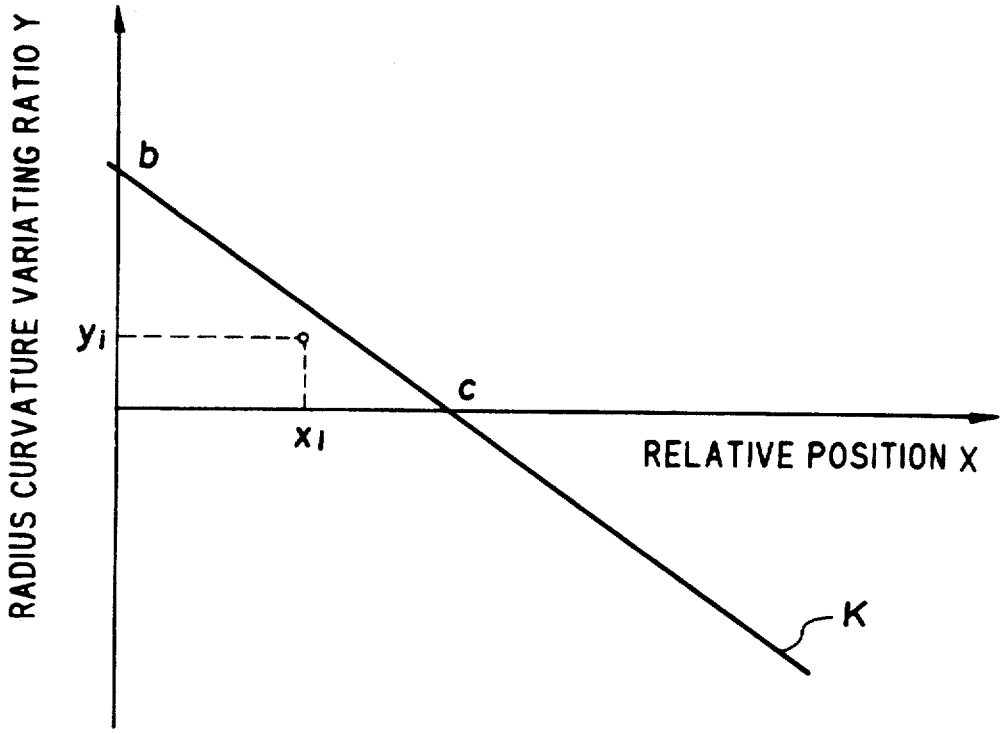
FIG. 7 is an explanatory view showing a fourth embodiment of an apparatus for polishing optical elements.

FIG. 7 shows a construction of a fourth embodiment of an apparatus carrying out a method of polishing optical elements according to the present invention.

In FIG. 7, a relative position is plotted in abscissa X and a curvature variation ratio is plotted in ordinate Y. The curvature variation ratio X may be obtained by measuring the radius curvature of a lens having been polished, comparing thus measured curvature value with the measured curvature value of the previously polished lens, and dividing the compared curvature value by the accumulated polishing time.

Provided that the relative position is $x_i$ and the radius curvature variation ratio is $y_i$ at certain time i, and the number of measurements is n, the following formulas are obtained. Sum $$Tx=\Sigma x_i \quad (1)$$

$$Ty=\Sigma y_i \quad (2)$$

square sum $$Txx=\Sigma x^2_i \quad (3)$$

$$Tyy=\Sigma y^2_i \quad (4)$$

$$Txy=\Sigma x_i y_i \quad (5)$$

average $$Mx=Tx/n \quad (6)$$

$$My=Ty/n \quad (7)$$

$$Sxx=Txx-nM^2x \quad (8)$$

$$Syy=Tyy-nM^2y \quad (9)$$

$$Sxy=Txy-nMxMy \quad (10)$$

Then, the following are obtained.
correlation coefficient $$R=Sxy/\sqrt{Sxx\cdot Syy} \quad (11)$$

inclination $$a=Sxy/Sxx \quad (12)$$

segment $$b=My-a\cdot Mx \quad (13)$$

The following is statistically obtained.
correlation formula $$Y=aX+b \quad (14)$$

The correlation degree becomes high as the absolute $|R|$ of the correlation coefficient R becomes close to 1. When the absolute value of the correlation coefficient is larger than the previously value, an expected curvature variation ratio $Y_{i+1}$ is obtained from the present measured radius curvature, a next expected radius curvature and the polishing time until the next machining, the following relative position may be determined therefrom.

$$x_{i+1}=(y_{i+1}-b)/a \quad (15)$$

In this way, formulas (1) to (5) and the measuring number of times n are renewed and stored successively and the statistical process of formulas (6) to (13), thereby determining the relative position from the formula (15), so that the correlation coefficient R becomes high as the measuring number of times are increased, thereby obtaining a radius curvature correction with excellent precision.

Fifth Embodiment

Figure 8:
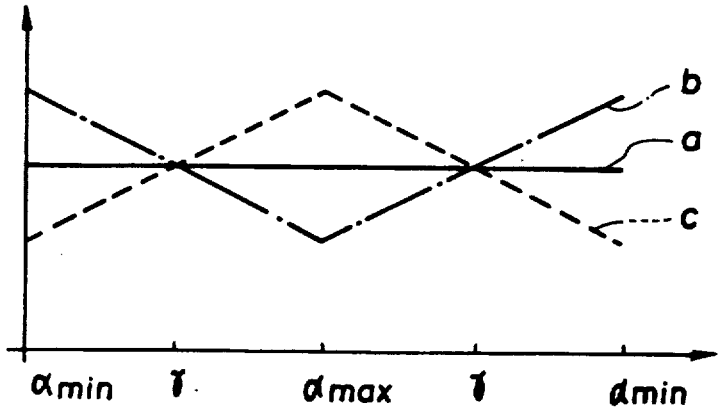
FIG. 8 is an explanatory view showing a fifth embodiment of an apparatus for polishing optical elements.

FIGS. 2 and 8 show a construction of a fifth embodiment of an apparatus carrying out a method of polishing optical elements according to the present invention.

In the first embodiment to the fourth embodiment, the relative position is changed as a machining or polishing condition, but in this embodiment, a depressing force is changed between the swinging angles $\theta$ ($\alpha_{min}$-$\sim\alpha_{max}$).

In FIG. 8, the angles of lens axis and wheel axis in time lapse is plotted along the abscissa and the depressing force corresponding to this angle is plotted along the ordinate. A solid line a shows the case that the depressing force does not change within 1 swinging cycle. A dot-dash line b shows the case that the depressing force is changed so as to obtain a maximum depressing force at $\alpha_{min}$ and a minimum depressing force at $\alpha_{max}$. A chain line a shows the case that the depressing force is changed so as to obtain a minimum depressing force at $\alpha_{min}$ and a maximum depressing force at $\alpha_{max}$. If the radius curvature of lens is machined stably with a pattern of solid line a, when the depressing force is changed with swinging motion at the pattern of the dot-dash line b, the load to the polishing tool becomes large at its center portion, so that the wear thereof becomes compared with its periphery portion. Therefore, the radius curvature becomes changed in the direction of small curvature for the concave lens and becomes changed in the direction of large curvature for the convex lens. For the dash line c, the reverse function is obtained.

The radius curvature of lens may also be corrected with the use of the curvature changing means by changing the depressing force variation pattern during the swinging.

Figure 9:
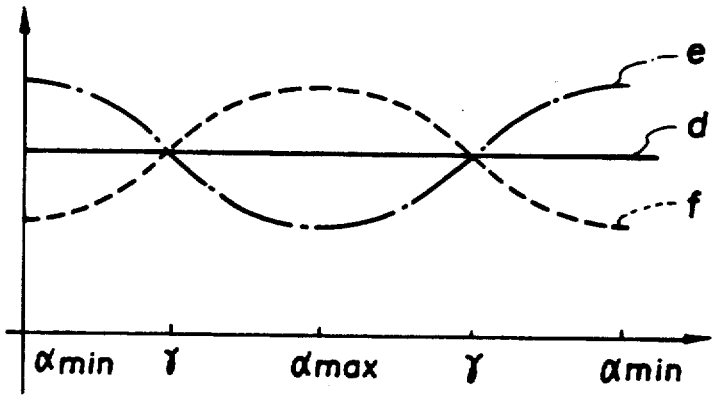
FIG. 9 is an explanatory view showing a variation of the apparatus shown in FIG. 8.

The depressing force may be changed along the curvature shown in FIG. 9 in addition to the straight line shown in FIG. 8.

In this embodiment, the depressing force is changed, but the residence time may be changed during the swinging motion and the swinging speed may also be changed in order to correct the radius curvature. As described above, according to the present invention, the wear amount of the tool at respective position may be adjusted and thus the radius curvature may be adjusted and corrected by changing the machining the machining conditions, such as the relative angle, the depressing force during swinging motion, and the residence time during the swinging motion.

What is claimed is:

1. A method of polishing optical elements having a curved surface, such as a lens, comprising the steps of:
   - pressing a polishing tool and a lens to be polished against each other, while rotating one of the lens and the polishing tool and reciprocating the other;
   - measuring the radius curvature of the polished lens;
   - providing an adjusting device for adjusting a relative position of the polishing tool and the lens to be polished;
   - supplying a predetermined allowed value for the radius curvature of a lens to the adjusting device and storing the predetermined allowed value in the adjusting device;
   - supplying the value of the radius curvature of the lens measured after having been polished to the adjusting device;
   - comparing the thus measured value of radius curvature with the measured value of radius curvature of a previously polished lens so as to calculate a variation value of radius curvature of the lens;
   - comparing the thus obtained curvature variation value with the predetermined allowed value for the radius curvature of the lens;
   - calculating a curvature correcting value in such a manner that the radius curvature of the lens does not exceed the predetermined allowed value;
   - calculating a correcting value for machining conditions of the lens to be polished and the polishing tool in accordance with the curvature variation value; and
   - setting the machining conditions in accordance with the thus obtained correcting value for machining conditions.

2. A method of polishing optical elements as claimed in claim 1; wherein the previously obtained machining conditions and the measured value of the curvature variation value are statically defined so as to obtain a relation between the curvature variation value and the machining conditions.

3. A method of polishing optical elements as claimed in claim 1; wherein the machining conditions are determined by setting the relative position of the lens for the polishing tool.

4. A method of polishing optical elements as claimed in claim 1; wherein the machining conditions are determined by changing the pressing force during the reciprocating motion.

5. A method of polishing optical elements as claimed in claim 1, wherein the machining conditions are determined by changing a residence time during the reciprocating motion.

6. A lens polishing apparatus for polishing a lens, comprising:
   - a polishing tool;
   - means for pressing the polishing tool against a lens to be polished;
   - means for rotating one of the lens and the polishing tool;
   - means for reciprocating the other of the lens and the tool;
   - setting means for setting a relative position of the polishing tool and the lens to be polished;
   - measuring means for measuring the radius curvature of a lens;

adjusting means for adjusting the setting means in accordance with an input signal from the measuring means;

a memory for memorizing a previously supplied and predetermined allowed value for the radius curvature of a lens;

means for determining a variation value of the radius curvature by comparing the value of the radius curvature measured by the measuring means with the measured value of radius curvature of a previously polished lens;

means for searching for a curvature correcting value by comparing the value of the radius curvature of the lens with the previously supplied and memorized allowed value of the radius curvature; and means for determining the machining conditions corrected for the reciprocating motion in accordance with the curvature correcting value such that the setting means is adjusted by the machining conditions selected in accordance with the correcting value of the machining condition determined by the adjusting means depending on the relative position between the polishing tool and the lens to be polished, the variation of the pressing force or the residence time during the reciprocating motion.

7. A lens polishing apparatus as claimed in claim 6; further comprising means for memorizing the relation statically obtained from the progress of the machining conditions and the radius curvature variation ratio; and means for predicting the radius curvature measured at this time, the radius curvature expected during a next polishing process and the machining time up to next measuring, whereby the correcting value for machining conditions during the reciprocating motion is determined in accordance with the radius curvature correcting value obtained by the predicting means.

8. A method for machining an optical element having a curved surface, comprising the steps of:

pressing a machining tool against an element to be machined;

rotating one of the tool and the element while reciprocating the other of the tool and element to effect machining of the element;

measuring a radius curvature of the element to be machined;

determining a curvature variation between the measured radius curvature of the element to be machined with a measured radius curvature of a previously machined element;

comparing the curvature variation value with a predetermined allowed value and producing a correcting value when the curvature variation exceeds the predetermined allowed value; and adjusting machining conditions of the element and the tool in response to the correcting value.

9. A method according to claim 8; wherein the step of adjusting comprises changing the relative position of the tool and the element.

10. A method according to claim 8; wherein the step of adjusting comprises changing a residence time during reciprocation.

11. A method according to claim 8; wherein the step of adjusting comprises changing the pressing force between the tool and element.

12. A device for machining an optical element having a curved surface, comprising:

means for pressing a machining tool against an element to be machined;

means for rotating one of the tool and the element while reciprocating the other of the tool and element to effect machining of the element;

means for measuring a radius curvature of the element to be machined;

means for determining a curvature variation between the measured radius curvature of the element to be machined with a measured radius curvature of a previously machined element;

means for comparing the curvature variation with a predetermined allowed value and producing a correcting value when the curvature variation exceeds the predetermined allowed value; and means for adjusting machining conditions of the element and the tool in response to the correcting value.

13. A device according to claim 12; wherein the means for adjusting comprises means for changing the relative positions of the tool and the element.

14. A device according to claim 12; wherein the means for adjusting comprises means for changing a residence time during reciprocation.

15. A device according to claim 12; wherein the means for adjusting comprises means for changing the pressing force between the tool and element.

* * * * *